US010344483B2

(12) United States Patent
Yu

(10) Patent No.: US 10,344,483 B2
(45) Date of Patent: Jul. 9, 2019

(54) BALUSTER JOINT BLOCK

(71) Applicant: LILUN PLASTICS ENTERPRISE CO., LTD, Changhua County (TW)

(72) Inventor: Ching-Chih Yu, Changhua County (TW)

(73) Assignee: LILUN PLASTICS ENTERPRISE CO., LTD., Changhua County (TW)

( * ) Notice: Subject to any disclaimer, the term of this patent is extended or adjusted under 35 U.S.C. 154(b) by 0 days.

(21) Appl. No.: 15/261,915

(22) Filed: Sep. 10, 2016

(65) Prior Publication Data

US 2018/0073250 A1 Mar. 15, 2018

(51) Int. Cl.
*E04F 11/18* (2006.01)
*E04H 17/22* (2006.01)

(52) U.S. Cl.
CPC ..... *E04F 11/1846* (2013.01); *E04F 11/1812* (2013.01); *E04F 11/1814* (2013.01); *E04H 17/22* (2013.01)

(58) Field of Classification Search
CPC ..... E04F 11/1812; E04F 11/1814; E04F 11/1846; E04F 11/1848; E04H 17/22
USPC ..... 256/65.14, 69
See application file for complete search history.

(56) References Cited

U.S. PATENT DOCUMENTS 6,141,928 A * 11/2000 Platt ..... E04F 11/1812 256/65.14
6,216,414 B1 * 4/2001 Feldberg ..... E04C 3/32 248/525
6,305,670 B1 * 10/2001 Ward ..... E04F 11/1842 256/59
6,718,710 B2 * 4/2004 Platt ..... E04F 11/1812 52/296
6,868,641 B2 * 3/2005 Conner ..... E01F 9/635 52/165

(Continued)

FOREIGN PATENT DOCUMENTS

FR 2322987 A1 * 4/1977 ..... E01F 15/0461

OTHER PUBLICATIONS

"Material Properties for Part Design." Jul. 25, 2010, https://web.archive.org/web/20100725161948/http://www.dc.engr.scu.edu/cmdoc/dg_doc/develop/material/property/a2200002.htm. Date Accessed: Oct. 1, 2018 (Year: 2010).*

(Continued)

*Primary Examiner* — Josh Skroupa
*Assistant Examiner* — Cory B Siegert

(57) ABSTRACT

A baluster joint block has a base and a baluster assembly, the base further comprising a plurality of protrusions, a plurality of positioning apertures and a first locking aperture disposed at a center position of the base; a lower end of the base provided with an inclined surface; a bottom end of the baluster assembly further comprising a plurality of indentions, a plurality of positioning points and a jointing section, a containment space formed between the jointing section and the baluster assembly, a second locking aperture disposed at a center position of a top surface of the jointing section, and a plurality of strips disposed on an outer surface of the jointing section, the plurality of indentions and the positioning points of the baluster assembly correspondingly matching the plurality of protrusions and the positioning apertures such that the baluster assembly engages with the base to form a connecting block.

8 Claims, 8 Drawing Sheets

(56) References Cited

U.S. PATENT DOCUMENTS

| | | | | |
|---|---|---|---|---|
| 6,948,283 | B2 * | 9/2005 | Burkart | B29C 33/005 248/346.01 |
| 7,077,386 | B1 * | 7/2006 | Gray, Jr. | E04F 11/1834 256/65.03 |
| 7,243,473 | B2 * | 7/2007 | Terrels | E04C 3/30 52/843 |
| 7,533,506 | B2 * | 5/2009 | Platt | E04H 12/2261 52/296 |
| 7,722,014 | B2 * | 5/2010 | Godwin | E04C 3/32 248/523 |
| 7,992,362 | B2 * | 8/2011 | Petta | E04C 3/30 52/301 |
| 2013/0328004 | A1 * | 12/2013 | Truckner | E04F 11/1834 256/65.01 |
| 2014/0217347 | A1 * | 8/2014 | Green | E04F 11/1812 256/66 |
| 2016/0145873 | A1 * | 5/2016 | Green | E04F 11/1812 52/832 |
| 2017/0204630 | A1 * | 7/2017 | Simmons | E04F 11/1812 |

OTHER PUBLICATIONS

Baird, Christopher S. "Why Are All Metals Magnetic?" Science Questions with Surprising Answers. Jan. 20, 2013. http://wtamu.edu/~cbaird/sq/2013/01/20/why-are-all-metals-magnetic/. Date Accessed: Oct. 1, 2018 (Year: 2013).*

* cited by examiner

BALUSTER JOINT BLOCK

BACKGROUND of INVENTION

1. Field of Invention

The present invention relates to a baluster joint block, and more particularly to an improved baluster joint block, which utilizes a joint block to attach onto a flat or inclined surface and to accept a baluster to be directly inserted.

2. Description of Related Art

Currently, most conventional balusters are made from wood, stone or metal.

A flat or recessed ramp is provided with an opening having a diameter corresponding to the baluster, so that the baluster is capable of being smoothly inserted into the opening. The most common applications are staircase, edges of the windows for preventing children from falling out.

However, the conventional structure described above still has the following problems: When a surface or ramp has a recessed opening, the dimension of the opening must meet the outer diameter of the baluster, and the distance between the openings and the depth of the opening must be indeed accurate. If the error occurs, the baluster is tilted, it will require the original opening to be filled up before a new opening to be opened. Therefore, it is easy resulting in higher costs.

Therefore, it is desirable to provide a baluster joint block to mitigate and/or obviate the aforementioned problems.

SUMMARY of INVENTION

An objective of present invention is to provide an improved baluster joint block, which utilizes a joint block to attach onto a flat or inclined surface and to accept a baluster to be directly inserted.

In order to achieve the above mentioned objective, a baluster joint block has a base and a baluster assembly. The base further includes a plurality of protrusions, a plurality of positioning apertures and a locking aperture disposed at a center position of the base. A lower end of the base is provided with an inclined surface. A bottom end of the baluster assembly further includes a plurality of indentions, a plurality of positioning points and a jointing section, a containment space formed between the jointing section and the baluster assembly, a locking aperture disposed at a center position of a top surface of the jointing section, and a plurality of strips disposed on an outer surface of the jointing section. The plurality of indentions and the positioning points of the baluster assembly correspondingly match the plurality of protrusions and the positioning apertures such that the baluster assembly engages with the base to form a connecting block. The locking member passes through the baluster assembly and the locking aperture of the base and is configured to engage an assembling aperture.

The joint block 1 can be applied between the hollow baluster 4 and the ramp A or the baluster assembly 11 can be directly installed between the baluster 4 and the flat surface B, and only a corresponding assembling aperture 3 is required to be fabricated on the ramp A and the flat surface B to complete the installation of the baluster 4.

Only the fabrication of the assembling aperture 3 on the ramp A and the flat surface B is required to finish the installation of the hollow baluster 4.

With the base 10 and the baluster assembly 11 together and the engagement between the locking member 2 and the assembling aperture 3 provide simple assembly for customer without hiring professional worker.

Other objects, advantages, and novel features of invention will become more apparent from the following detailed description when taken in conjunction with the accompanying drawings.

DETAILED DESCRIPTION OF PREFERRED EMBODIMENT

Figure 1:
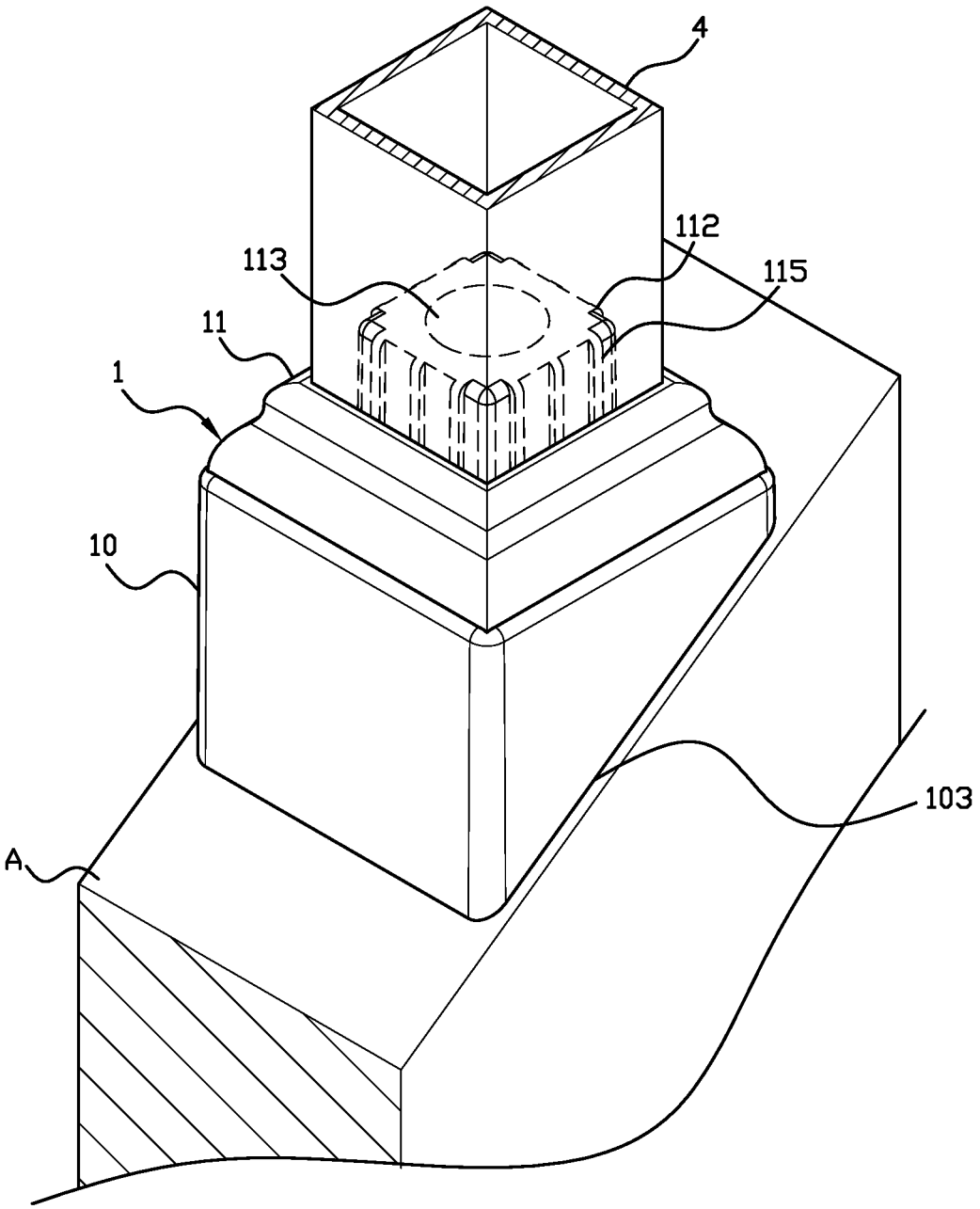
FIG. 1 is a perspective assembly drawing of a preferred first embodiment according to the present invention.
Figure 2B:
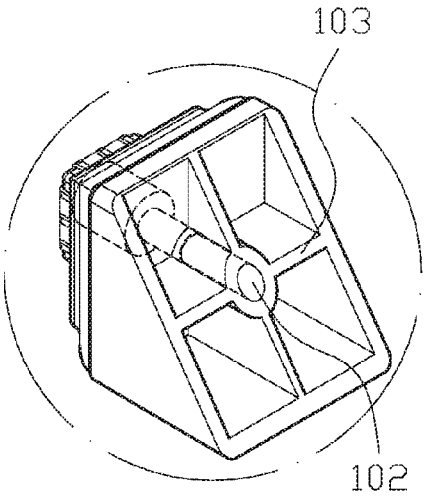
FIG. 2 is a perspective exploded drawing of the preferred first embodiment according to the present invention.
Figure 2A:
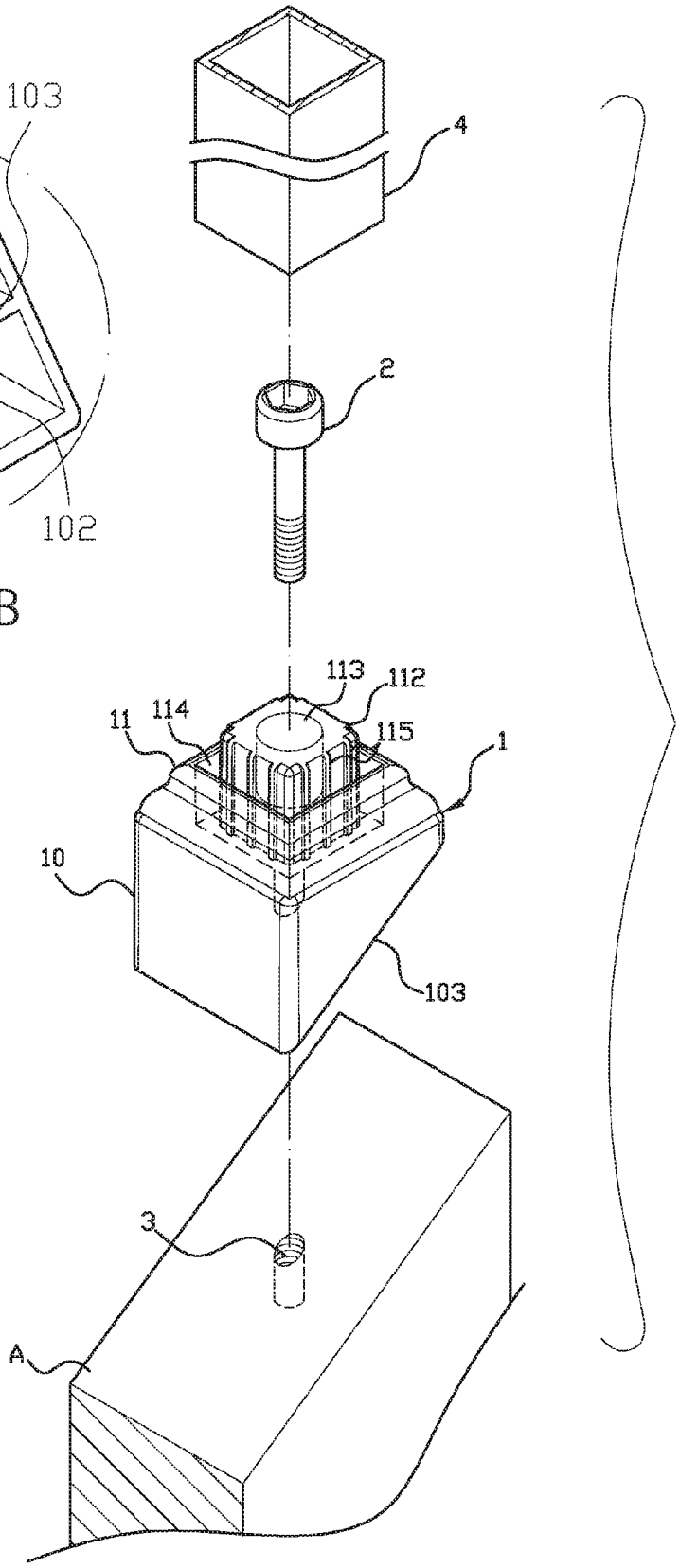
Figure 3:
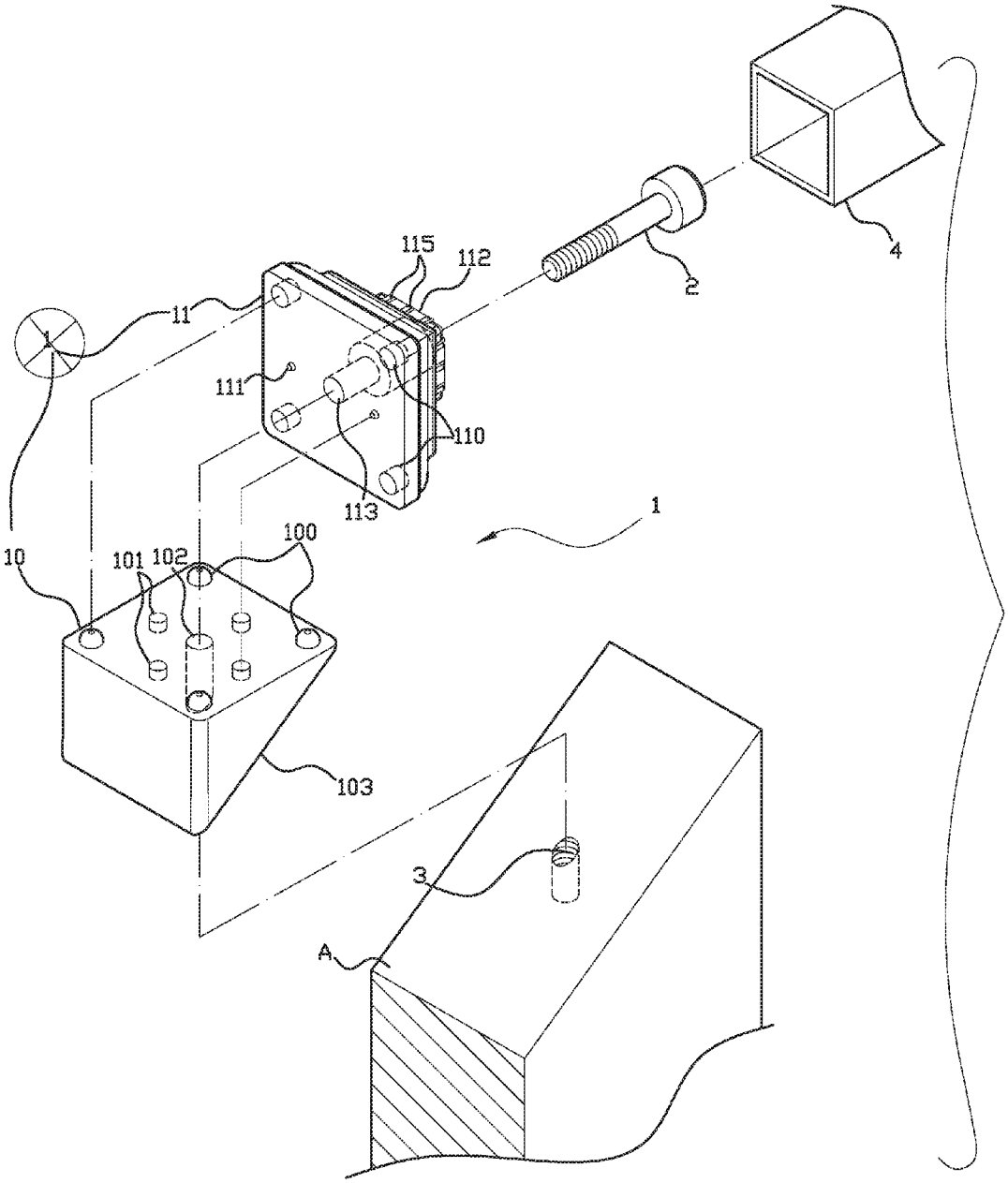
FIG. 3 is another perspective exploded drawing of the preferred first embodiment according to the present invention.
Figure 4:
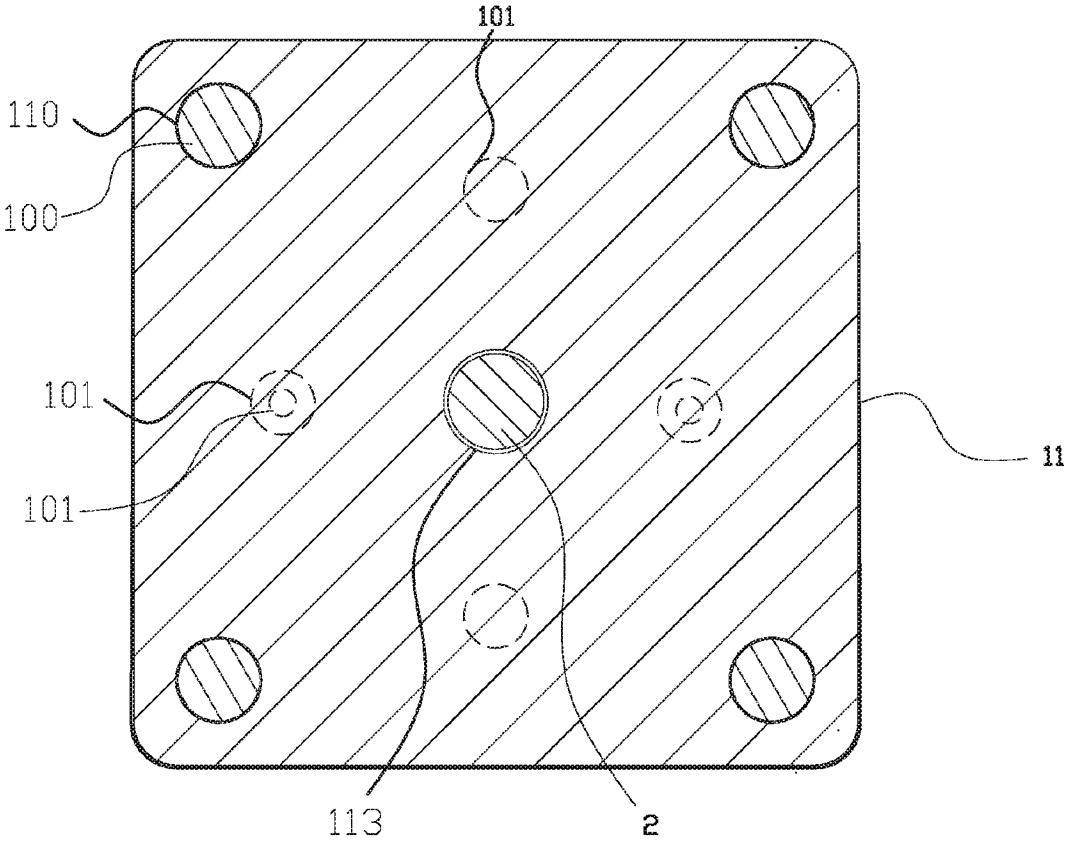
FIG. 4 is a cross-sectional drawing of the base and the baluster assembly according to the present invention.

Please refer to FIG. 1 to FIG. 3. A baluster joint block 1 comprises: a base 10 and a baluster assembly 11. The base 10 further comprises a plurality of protrusions 100, a plurality of positioning apertures 101 and a first locking aperture 102 disposed at a center position of the base 10. A lower end of the base is provided with an inclined surface. A bottom end of the baluster assembly 11 further comprise a plurality of indentions 110, a plurality of positioning points 111 and a jointing section 112. Furthermore, a containment space 114 is formed between the jointing section 112 and the baluster assembly 11, and a second locking aperture 113 is disposed at a center position of a top surface of the jointing section 112 and a plurality of strips 115 are disposed on an outer surface of the jointing section 112. The plurality of indentions 110 and the positioning points 111 of the baluster assembly 11 correspondingly match the plurality of protrusions 100 and the positioning apertures 101 such that the baluster assembly 11 engages with the base 10 to form a joint block 1, as shown in FIG. 4. Moreover, the locking member 2 passes through the baluster assembly 11 and the first and second locking apertures 102,113 of the baluster assembly 11 and the base 10 and is configured to engage an assembling aperture 3 located on an external joint surface A or B.

In addition, an upper end of the base 10 and a bottom end of the baluster assembly 11 have respective shapes that correspond with each other. The protrusions 100 are disposed on an outer edge of the upper end of the base 10, and the indentions 110 are disposed on an outer edge of the lower end of the baluster assembly 11. The plurality of strips 115 are tapered and evenly disposed on the outer surface of the jointing section 112. The containment space 114 has a respective shape that corresponds with a baluster 4. The base 10 and the baluster assembly 11 each have at least one corresponding magnetic contact surface for mutual engagement. The strip 115 is elastic, and the locking member 2 is a screw.

Figure 5:
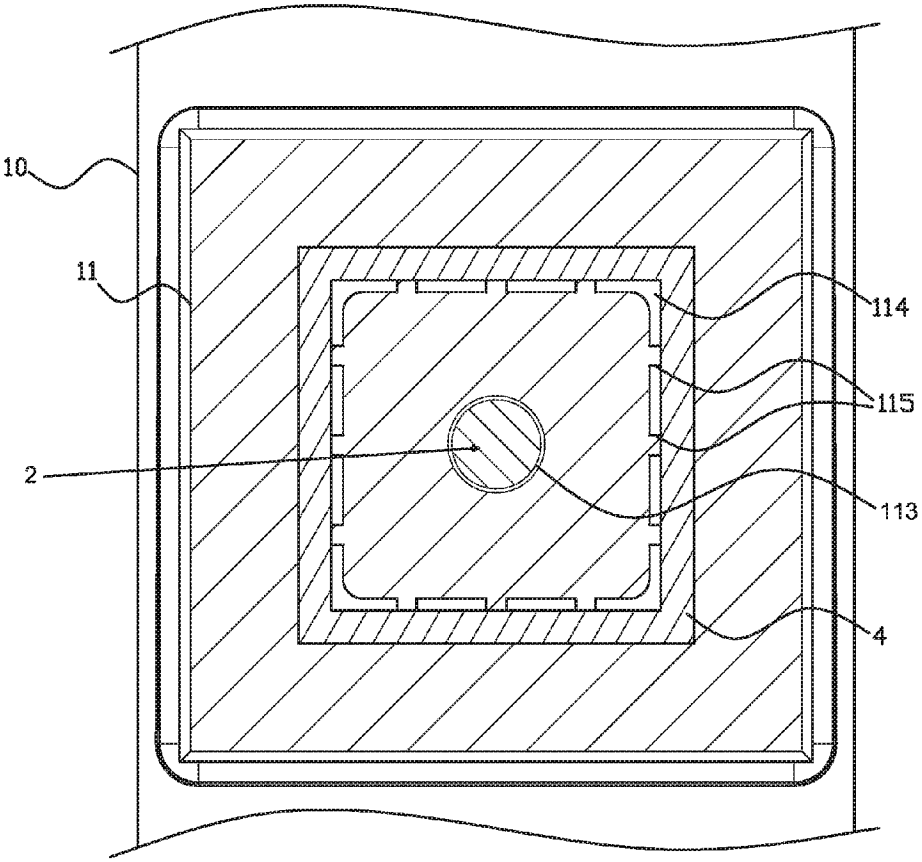
FIG. 5 is a top view of the preferred first embodiment according to the present invention.
Figure 6:
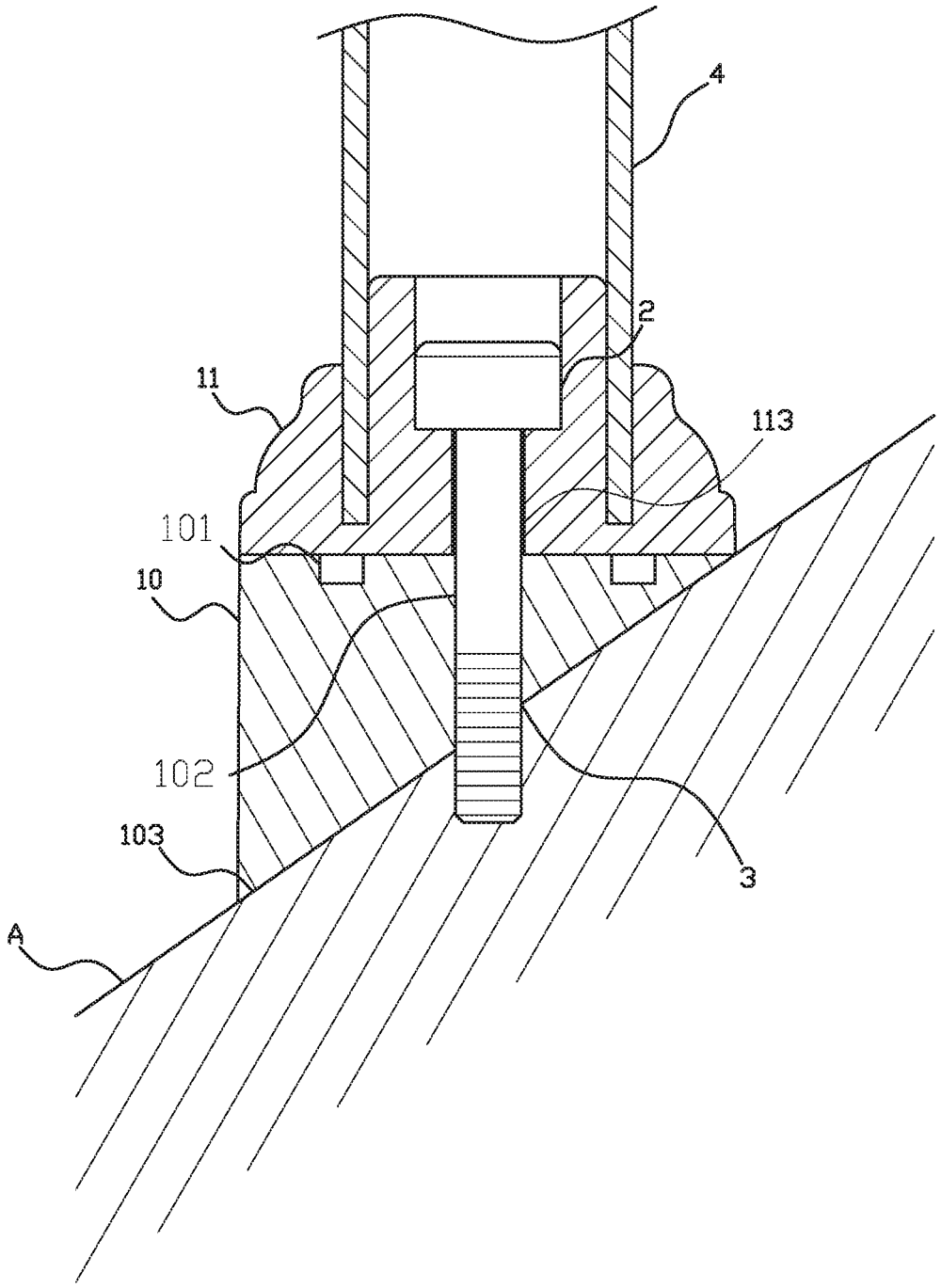
FIG. 6 is another assembly drawing of the preferred first embodiment.
Figure 7:
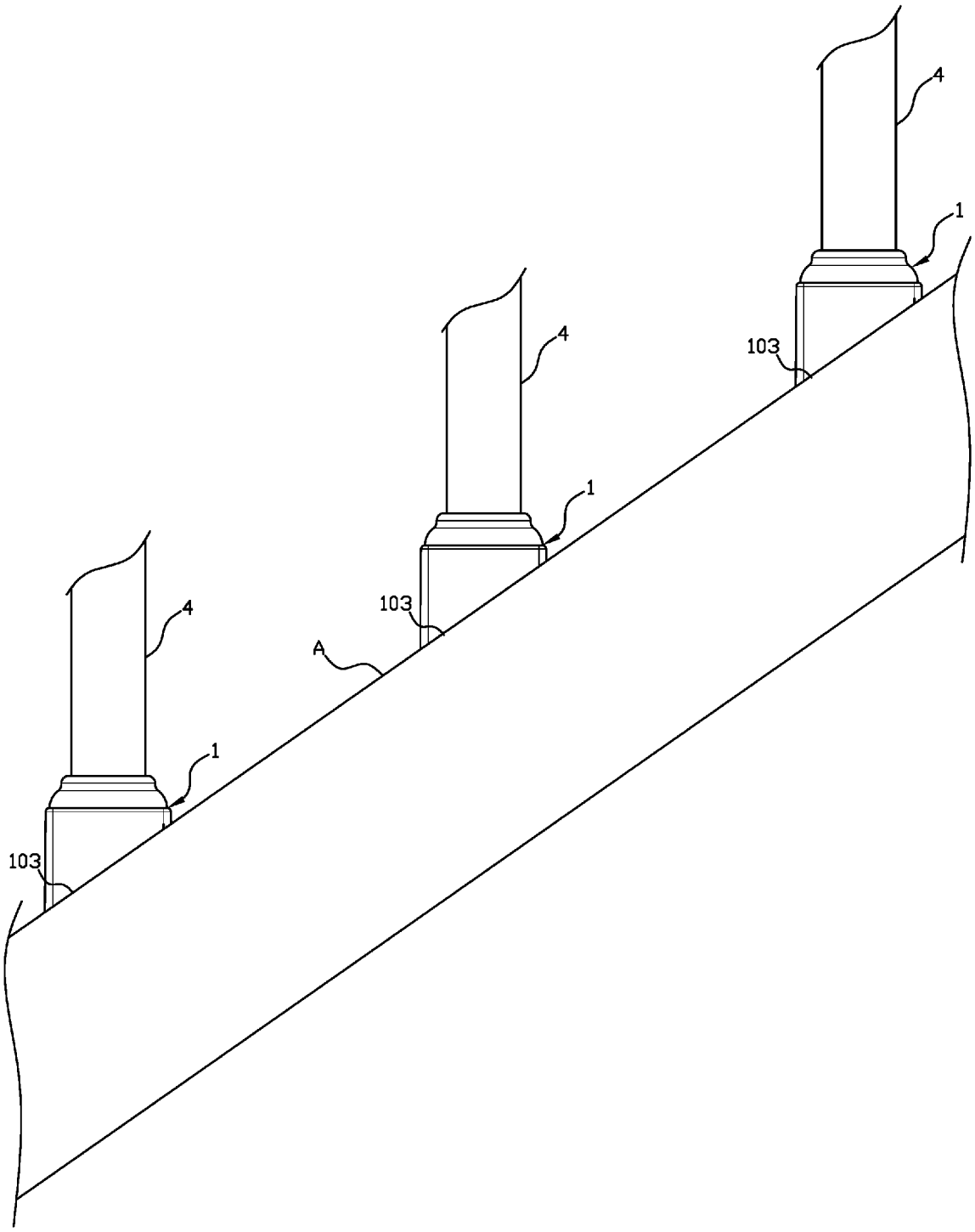
FIG. 7 shows the present invention being applied with a stairway.

As shown in FIG. 6 and FIG. 7, according to a first preferred embodiment of the present invention, in order to install a hollow baluster 4 onto an ramp A, an assembling aperture 3 is disposed on the ramp A, the inclined surface 103 of the joint block 112 is leaned against the ramp A, and the first and second locking apertures 102, 113 are aligned with the assembling aperture 3. Therefore, the locking member 2 passes through the first and second locking apertures 102, 113 and is engaged with the assembling aperture 3. With the plurality of strips 115 located on the outer surface of the jointing section 112, when the baluster 4 is inserted into the containment space 114, a bottom of the baluster 4 pushed against the lower section of the strip 115 to cause the upper section of the strip 115 to deform against the baluster 4. Therefore, the baluster 4 can securely installed in the containment space 114, as shown in FIG. 5.

Figure 8:
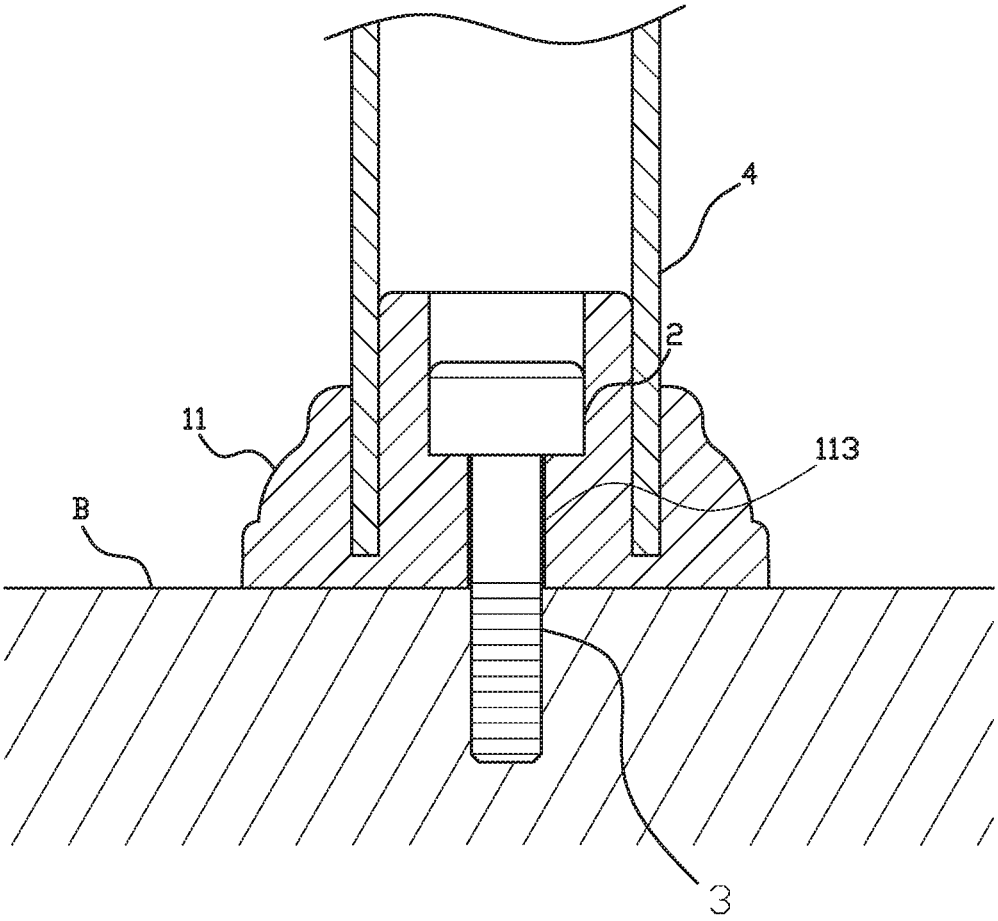
FIG. 8 is an assembly drawing of a preferred second embodiment according to the present invention.

Please refer to FIG. 8. According to another embodiment of the present invention, in order to install the hollow baluster 4 onto a flat surface B, an assembling aperture 3 is disposed on the flat surface B, the baluster assembly 11 is pushed against the flat surface B, and the second locking aperture 113 is aligned with the assembling aperture 3. Therefore, the locking member 2 passes through the second locking apertures 113 and is engaged with the assembling aperture 3. Furthermore, the hollow baluster 4 is inserted into the containment space 114 as described in the first embodiment.

With the above-mentioned structure, following benefits can be obtained: 1. The joint block 1 can be applied between the hollow baluster 4 and the ramp A or the baluster assembly 11 can be directly installed between the baluster 4 and the flat surface B, and only a corresponding assembling aperture 3 is required to be fabricated on the ramp A and the flat surface B to complete the installation of the baluster 4. 2. Only the fabrication of the assembling aperture 3 on the ramp A and the flat surface B is required to finish the installation of the hollow baluster 4. 3. With the base 10 and the baluster assembly 11 together and the engagement between the locking member 2 and the assembling aperture 3 provide simple assembly for customer without hiring professional worker.

Although the present invention has been explained in relation to its preferred embodiment, it is to be understood that many other possible modifications and variations can be made without departing from the spirit and scope of invention as hereinafter claimed.

What is claimed is:

1. A baluster joint block comprising:

a base; and a baluster assembly;

wherein:

an upper end of the base comprises a plurality of protrusions, a plurality of positioning apertures, and a first locking aperture disposed at a center position of the base;

a lower end of the base is provided with an inclined surface;

a bottom end of the baluster assembly comprises a plurality of indentions corresponding to the plurality of protrusions, and a plurality of positioning points corresponding to the plurality of positioning apertures;

a top end of the baluster assembly comprises a jointing section disposed in a center portion of the baluster assembly, an annular containment space having a shape corresponding to an outer circumference of a baluster is formed in the top end between an outer surface of the jointing section and a surface of the top end of the baluster assembly, the containment space in the top end configured to accept the baluster so that the outer circumference of the baluster is fixed in the containment space by the outer surface of the jointing section and the top end of the baluster assembly, a second locking aperture disposed through the jointing section, and a plurality of strips disposed on the outer surface of the jointing section; and the plurality of indentions and the plurality of positioning points of the baluster assembly engage the plurality of protrusions and the plurality of positioning apertures of the base to form a connecting block, and the first and second locking apertures are configured to accept a locking member that passes through the connecting block to engage with an assembling aperture.

2. The joint block as claimed in claim 1, wherein the upper end of the base and the bottom end of the baluster assembly have corresponding shapes.

3. The joint block as claimed in claim 1, wherein the protrusions are disposed on an outer edge of the upper end of the base, and the indentions are disposed on an outer edge of the bottom end of the baluster assembly.

4. The joint block as claimed in claim 1, wherein the plurality of strips are evenly disposed on the outer surface of the jointing section.

5. The joint block as claimed in claim 1, wherein the containment space has a square annular shape that corresponds to the outer circumference of the baluster.

6. The joint block as claimed in claim 1, wherein the strips are elastic.

7. The joint block as claimed in claim 1, wherein the base and the baluster assembly each have at least one corresponding magnetic contact surface for mutual magnetic engagement.

8. The joint block as claimed in claim 1, wherein the locking member is a screw.

* * * * *